US008123221B2

(12) United States Patent
Blumle

(10) Patent No.: US 8,123,221 B2
(45) Date of Patent: Feb. 28, 2012

(54) APPARATUS AND METHOD FOR DRAWING IN FLAT MATERIAL PIECES AND IN-REGISTER TRANSPORTATION OF THE FLAT MATERIAL PIECES

(75) Inventor: Martin Blumle, Horhausen (DE)

(73) Assignee: Winkler + Dünnebier AG, Neuwied (DE)

( * ) Notice: Subject to any disclaimer, the term of this patent is extended or adjusted under 35 U.S.C. 154(b) by 232 days.

(21) Appl. No.: 12/671,160

(22) PCT Filed: Jul. 15, 2008

(86) PCT No.: PCT/EP2008/005740

§ 371 (c)(1),
(2), (4) Date: Jan. 28, 2010

(87) PCT Pub. No.: WO2009/015761

PCT Pub. Date: Feb. 5, 2009

(65) Prior Publication Data

US 2010/0201060 A1 Aug. 12, 2010

(30) Foreign Application Priority Data

Jul. 28, 2007 (DE) ..... 10 2007 035 435

(51) Int. Cl.
*B65H 5/12* (2006.01)

(52) U.S. Cl. ..... 271/268; 271/197; 271/276; 271/277; 271/900

(58) Field of Classification Search ..... 271/82, 271/196, 197, 268, 275, 276, 277, 900
See application file for complete search history.

(56) References Cited

U.S. PATENT DOCUMENTS

| | | | | |
|---|---|---|---|---|
| 3,791,642 | A | 2/1974 | Schunemann | |
| 5,938,193 | A * | 8/1999 | Bluemle et al. | 271/243 |
| 6,702,283 | B2 * | 3/2004 | Berlingen et al. | 271/276 |

(Continued)

FOREIGN PATENT DOCUMENTS

| | | | |
|---|---|---|---|
| DE | 19 17 795 | A1 | 11/1969 |
| DE | 24 39 790 | A1 | 3/1976 |
| DE | 44 39 808 | A1 | 5/1996 |
| DE | 202004009490 | U1 | 11/2004 |

(Continued)

OTHER PUBLICATIONS

International Search Report w/translation from PCT/EP2008/005740 dated Feb. 12, 2008 (4 pages).

*Primary Examiner* — Jeremy R Severson
(74) *Attorney, Agent, or Firm* — Osha • Liang LLP

(57) ABSTRACT

A device for pulling in flat-stock pieces and precisely-aligned transporting of the flat-stock pieces at a work station of a machine for processing the flat-stock pieces has a gripper apparatus that grabs a forward edge of a piece of flat stock and accelerates the flat-stock piece, and a sheet pick-up roller that picks up the accelerated piece of flat stock from the gripper apparatus, whereby the sheet pick-up roller has a roller gripper effective at a circumference thereof for grabbing the accelerated piece of flat stock. The roller gripper can move between a closed position in which the piece of flat stock is held fast and an open position in which the piece of flat stock is released. Suction holes operable to be charged with intake air are disposed in a part of a circumference of the sheet pick-up roller following in a direction of rotation behind the roller gripper.

20 Claims, 5 Drawing Sheets

U.S. PATENT DOCUMENTS

Figure 1:
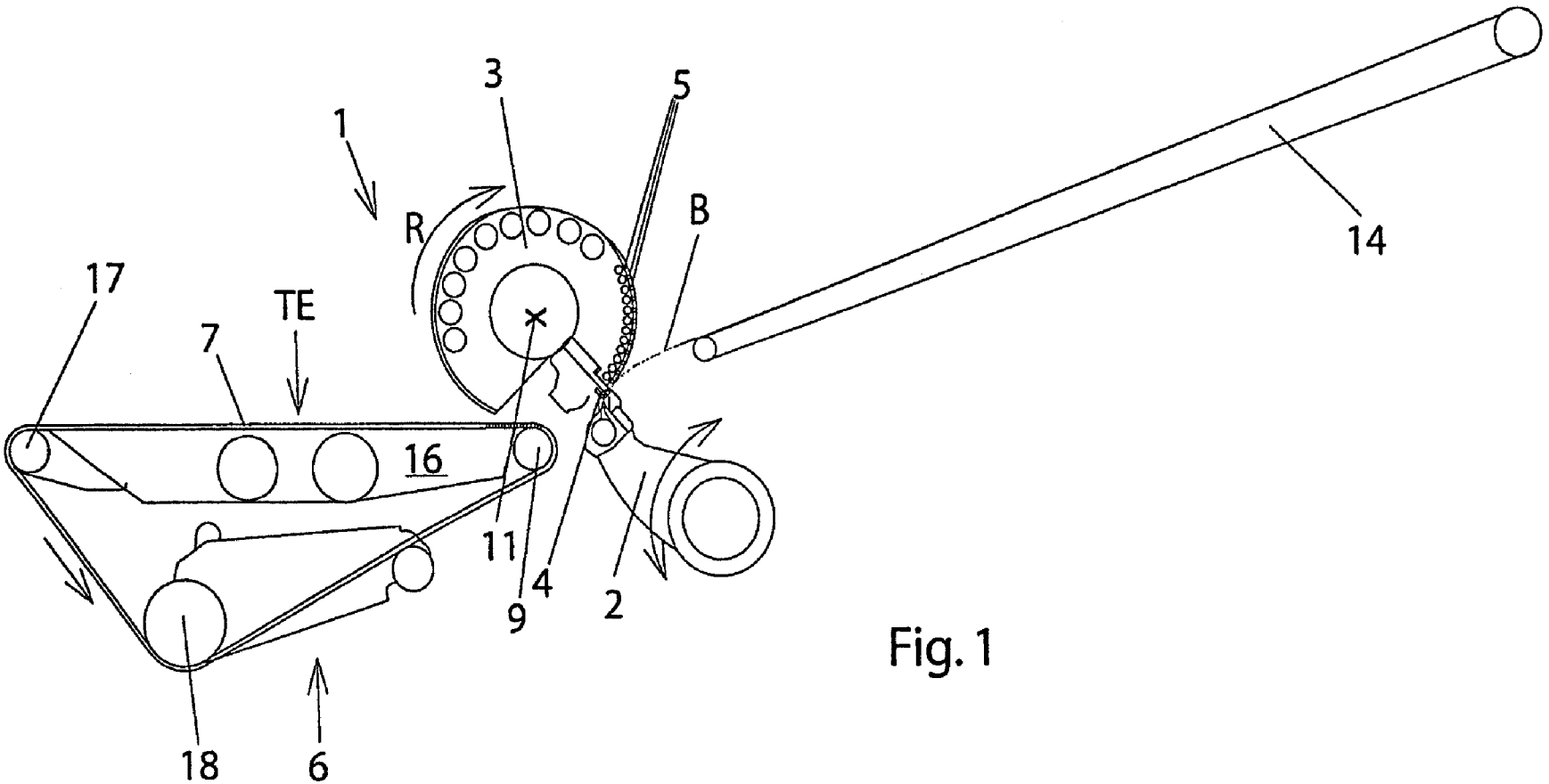

| | | | | |
|---|---|---|---|---|
| 7,845,636 | B2 * | 12/2010 | Isaak et al. | 271/243 |
| 2002/0135123 | A1 * | 9/2002 | Maul et al. | 271/277 |
| 2004/0026851 | A1 * | 2/2004 | Schaede et al. | 271/277 |
| 2004/0164481 | A1 * | 8/2004 | Edinger | 271/197 |
| 2005/0012265 | A1 * | 1/2005 | Berlingen et al. | 271/276 |
| 2009/0139838 | A1 | 6/2009 | Isaak et al. | |

FOREIGN PATENT DOCUMENTS

| | | | |
|---|---|---|---|
| DE | 10 2004 020 252 | A1 | 12/2004 |
| DE | 102004058601 | A1 * | 8/2005 |
| DE | 10 2006 015 731 | A1 | 10/2007 |
| EP | 0 864 520 | A1 | 9/1998 |
| EP | 1 801 060 | A1 | 6/2007 |

* cited by examiner

APPARATUS AND METHOD FOR DRAWING IN FLAT MATERIAL PIECES AND IN-REGISTER TRANSPORTATION OF THE FLAT MATERIAL PIECES

I. AREA OF APPLICATION

The present invention concerns a device as well as a method for pulling in flat-stock pieces and precisely-aligned feed of flat-stock pieces at a work station of a rotary machine for processing flat-stock pieces. Among the flat-stock pieces handled are, in particular, flat-stock sheets made of cardboard or pulp sheet, and among the rotary machines involved are, in particular, a rotary die cutter which makes folding-box blanks out of the previously mentioned flat-stock sheets for later production of folded boxes, for example folded boxes for medicines. Among the flat-stock pieces, however, other types of sheet or envelope blanks, etc. can also be handled.

II. TECHNICAL BACKGROUND

With sheet printing machines, it is well-known that they pull in the sheet(s) being printed from a shingle flow. Here a pivoting gripper grabs the forward edge of the sheet to be pulled in and accelerates it to the cycling speed of the rotary sheet printing machine. A sheet pick-up roller which exhibits one or several roller grippers disposed on its circumference takes up the accelerated sheet from the pivoting gripper with the aid of the roller gripper. The sheet picked up is then further fed by the sheet pick-up roller over some angular sector and finally transfers it, precisely aligned and at cycling speed to the gripper of the rotating printing cylinder.

By way of example, within the scope of the rotary manufacture of folded-box blanks made of sheets of cardboard or pulp sheet, it is advantageous—due to their proportionally high bend strength if compared to paper sheet—to feed in the sheets as straight a line as possible to suction belts at least in that area of the rotary machine in which precise alignment is important. No proposals are known to date in prior art for the type and manner of the precisely-aligned pulling in of sheets to a suction belt.

III. DESCRIPTION OF THE INVENTION a) Technical Problem

It is hence the task of the present invention to produce a device as well as a method for pulling in flat-stock pieces and for the precisely-aligned feed of flat-stock pieces at a work station of a rotary machine for processing flat-stock pieces, which makes possible the precisely-aligned pulling of pieces of flat stock, particularly sheets, in a rotary-machine suction belt that transports the pieces of flat stock further.

b) Solution to the Problem

This problem is solved by means of a device and by means of a method with the features of claims 1 and 6. Further embodiments of the present invention result from the subclaims.

According to the invention, it is proposed to provide (the) sheet pick-up roller with several suction holes which can be charged with intake air in a portion of its circumference or its housing surface in the direction of its rotation behind at least one roller gripper. Using these suction holes, the piece of flat stock is held, besides by the roller gripper, at least partially on the circumference of the sheet pick-up roller. A suction conveyor-belt apparatus exhibits at least one suction belt which can be charged with intake air, to which the piece of flat stock is transferred from the sheet pick-up roller according to the invention. At the same time, the opening of the roller gripper and thus the release of the forward edge of the piece of flat stock to be transferred, as well as the intake-air charge of the suction holes provided in the sheet pick-up roller can be controlled such that the piece of flat stock can be transferred from the sheet pick-up roller to the suction belt essentially without slipping.

The suction holes disposed in the sheet pick-up roller, in addition to the roller gripper, guarantee in an advantageous manner secure feed even with variations in the thickness of the flat-stock pieces. This results from the fact that a gripper always has to be installed for a specified thickness of the piece of flat stock. A relatively thin piece of flat stock which falls below the specified thickness hence may not be held sufficiently firmly by the gripper and as a result may not be held without slipping. In this case, the intake air sucked through the suction holes ensures that the relatively thin pieces of flat stock are held firmly and without slipping on the sheet pick-up roller in spite of the reduced action of the gripper. Within the scope of the present invention, looser tolerances can consequently be tolerated with respect to the thickness of the piece of flat stock.

While the suction belt is continuously being charged with intake air, the intake-air charge to the suction holes in the sheet pick-up roller can, on the one hand, be controlled for the sheet pick-up roller to pick up the piece of flat stock from the gripper apparatus and on the other hand to transfer the flat-stock piece from the sheet pick-up roller to the suction belt.

When transferring the flat-stock pieces from the sheet pick-up roller to the suction belt, at the same time as or immediately after the opening of the roller gripper, the suction holes beginning with the suction holes lying next to the roller gripper circumferentially are operated against the direction of rotation of the sheet pick-up roller one after the other at the least without intake air. At the same time, the piece of flat stock is held in a portion increasing in size or area essentially without slipping on the suction belt, and is transported in a portion decreasing in size or area and being still held on the sheet pick-up roller in a guiding manner.

Operating the suction holes without intake air occurs in a known manner with the aid of a control valve, which is disposed on one of the front sides of the sheet pick-up roller. Within the scope of the present invention, it is conceivable not only to cut off the intake-air charge of the suction holes, but to charge them in addition with compressed air against the rotation direction of the sheet pick-up roller one after the other, and in this way to support the detachment process of the flat-stock piece from the surface of the sheet pick-up roller. This optional measure will be grasped from the phrasing "at the least without intake-air" used in the present application.

Preferably, the suction holes are constructed in a known manner in the form of rows of suction holes, each being disposed parallel to the axis of the sheet pick-up roller and comprising a plurality of suction holes. The gradual cut-off of the intake-air charge against the rotation direction of the sheet pick-up roller can occur row-by-row according to the invention, so that the rows of suction holes are operated one after the other without intake air. Alternatively, the possibility exists to combine two or several rows of suction holes adjacent circumferentially to a group of suction holes and the groups of suction holes created thereby operating at the least without intake air individually one after the other.

The control of the intake-air charge of the suction holes occurs with the transfer of the flat-stock piece by the sheet pick-up roller from the gripper apparatus in such a way that the suction holes, beginning with the suction holes lying circumferentially next to the roller gripper, are operated against the rotation direction of the sheet pick-up roller one after the other from the state without intake air to the state of being charged with intake air. Here also as an alternative to row-by-row guidance, two or several rows of circumferentially adjacent suction holes may be combined to a group of suction holes and the suction-hole groups thus created can be operated individually one after the other from the state without intake air to the state of being charged with intake air.

The axis of the sheet pick-up roller is preferably disposed essentially vertically above the axis of the guide pulley to guide the continuously running suction belt. If such an arrangement is chosen, it cannot be avoided that in that area of the suction belt in which the piece of flat stock will be picked up, there is a zone with no suction effect.

Provided this is the case, the roller gripper can then first be opened, if required, when the forward edge which it holds of the flat-stock piece to be transferred is fed by the sheet pick-up roller through the zone with no suction effect.

It is conceivable to arrange the axis of the sheet pick-up roller horizontally offset relatively to the axis of the guide pulley, so that the forward edge of the piece of flat stock to be transferred can be moved tangent to the transport plane of the suction belt in its suction zone. If such a horizontal setting is not possible, then the forward edge of the flat-stock piece can be fed with the closed roller gripper through the zone without suction effect and at the same time be moved a little out of the transport plane of the suction belt or can be lifted up or raised out of it. A positively secured transport transition of the zone of the suction belt without suction effect can be attained in this way, if necessary.

The roller gripper or grippers protrudes or protrude radially from the housing surface of the sheet pick-up roller. In order to make it possible for the transport plane of the suction belt to end up lying tangent to the movement path of the surface area of the sheet pick-up roller that is provided with suction holes, the suction belt exhibits a number of drop spaces corresponding in number to roller grippers into which the respective roller gripper can drop when transferring the piece of flat stock to the suction belt. Either throughholes or, if necessary, just recesses in the suction belt can act as the drop spaces. Alternatively, there is the possibility of providing the suction conveyor-belt apparatus with several suction belts or suction straps running parallel to one another and with spaces in between. The roller gripper or grippers can then drop into each one of the spaces when transferring the flat-stock piece to the suction belts or suction straps.

c) Embodiment Example

Figure 2:
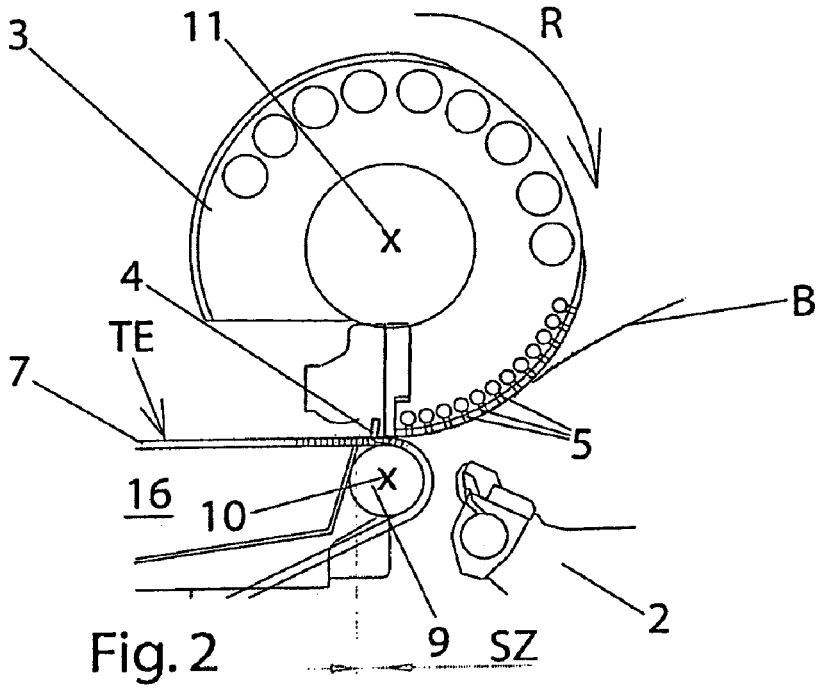
Figure 3:
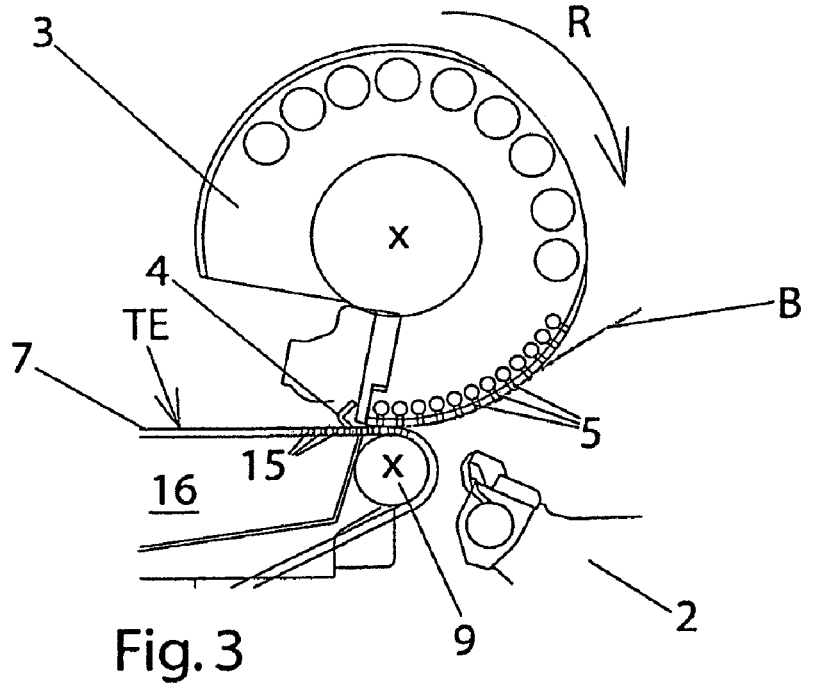
Figure 4:
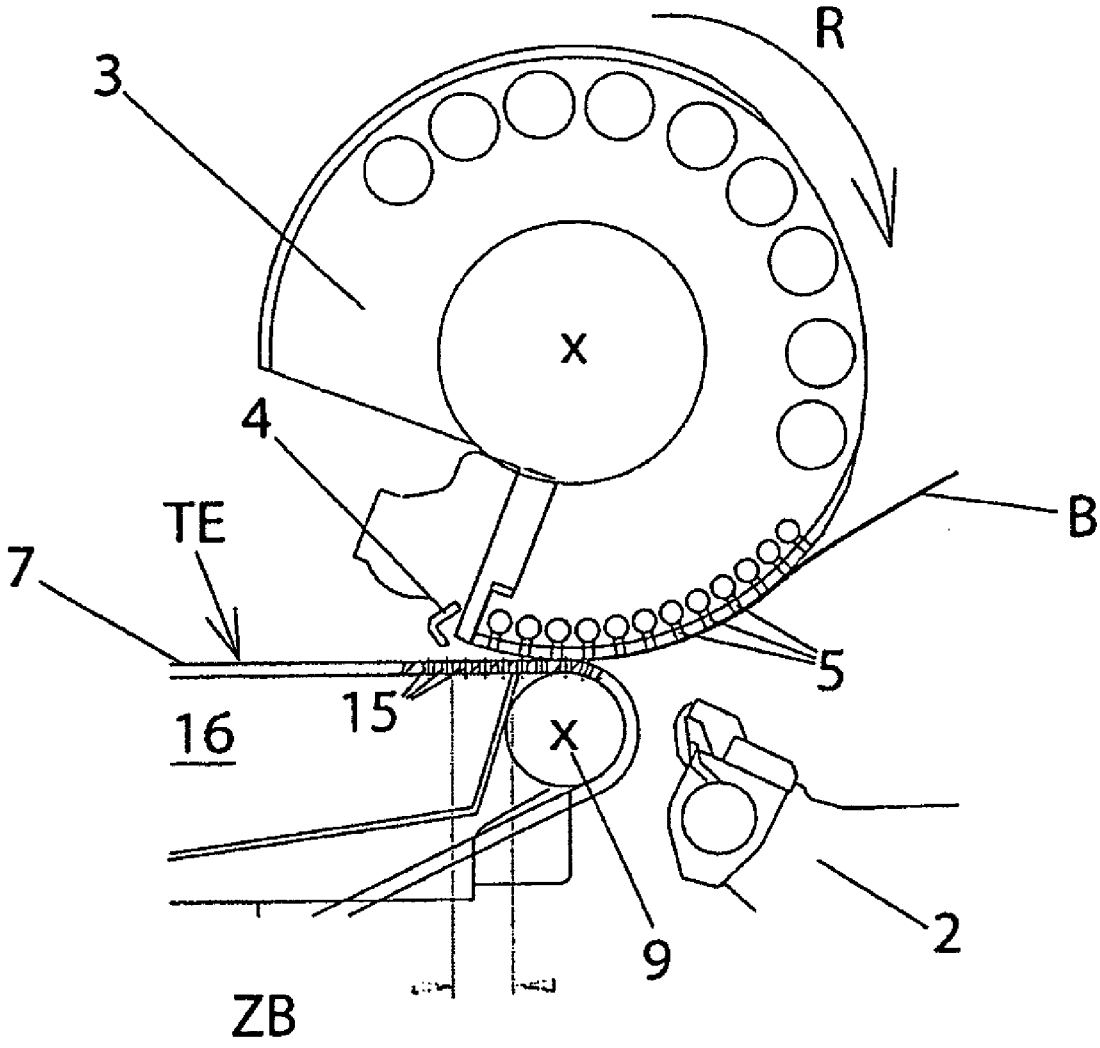
Figure 5:
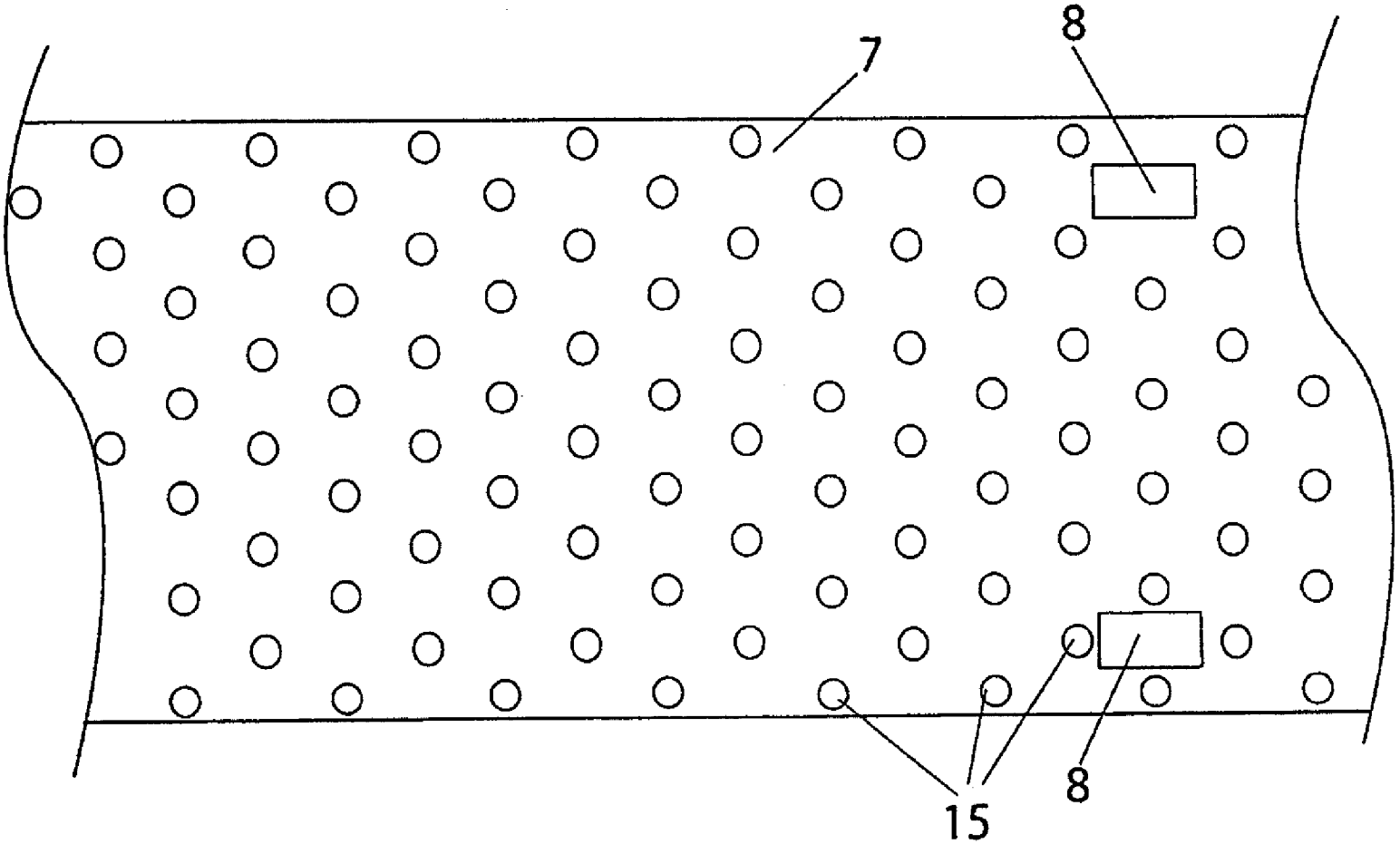
Figure 6:
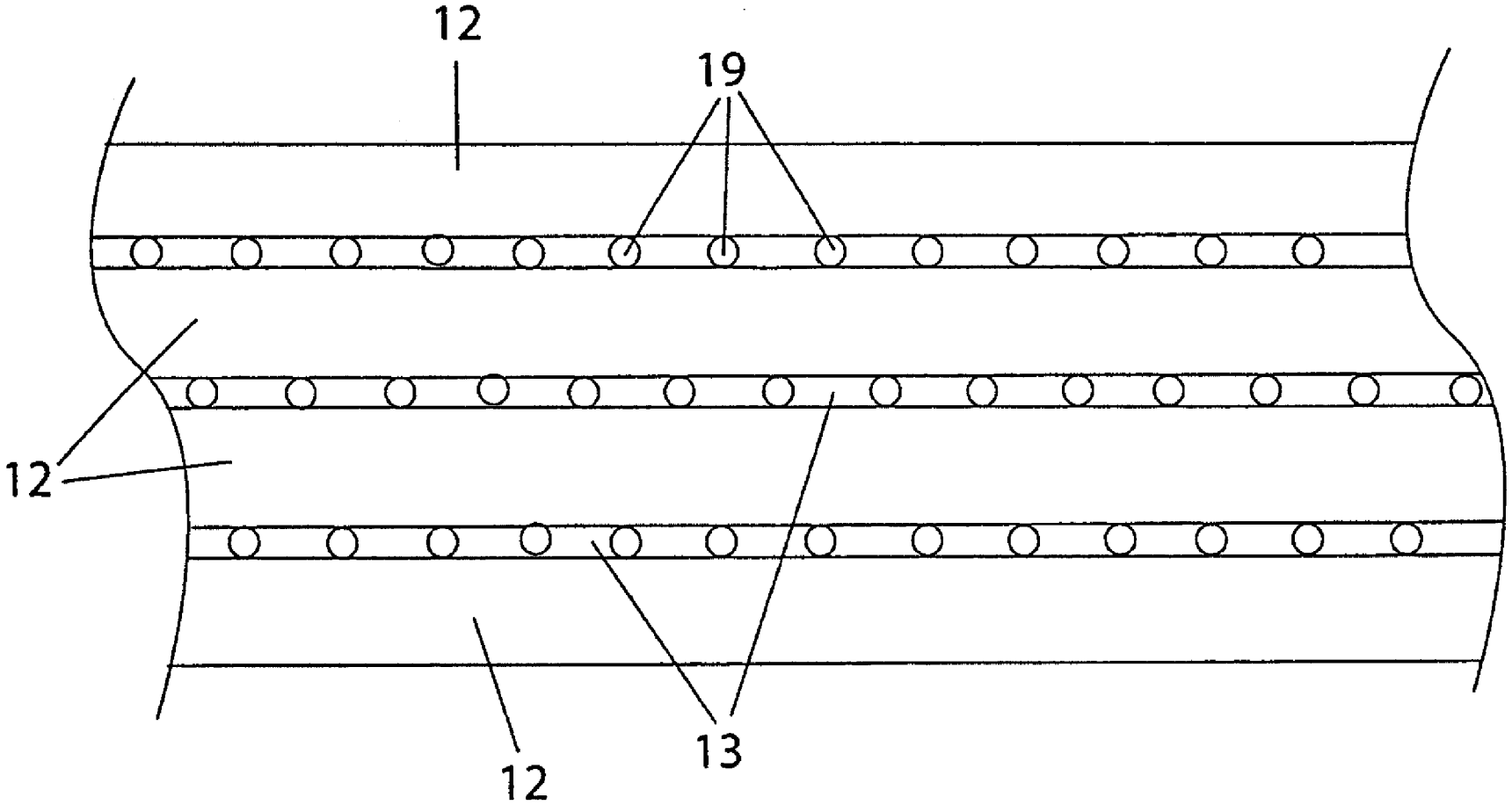

One embodiment of the present invention is described below by way of example, using the drawings enclosed. They show:

FIG. 1 a schematic side view of an embodiment of the device according to the invention, in which the transfer of a sheet of flat stock from the gripper apparatus to the sheet pick-up roller is shown;

FIG. 2 a detail view of FIG. 1 in which a first rotation position of the sheet pick-up roller is shown within the framework of transferring a sheet of flat stock to the suction belt;

FIG. 3 a detail view of FIG. 1 in which a second rotation position of the sheet pick-up roller is shown within the framework of transferring a sheet of flat stock to the suction belt;

FIG. 4 a detail view of FIG. 1 in which a third rotation position of the sheet pick-up roller is shown within the framework of transferring a sheet of flat stock to the suction belt;

FIG. 5 a view of one embodiment of the suction belt of the suction conveyor-belt apparatus; and FIG. 6 a view of several suction belts as an alternative to the single suction belt according to FIG. 5.

In FIG. 1, one embodiment of a device 1 according to the invention which serves as a feed apparatus of a rotary die cutter for making folded-box blanks out of pieces of flat stock in the form of sheets of flat stock made of cardboard or pulp sheet. Several folded-box blanks, not depicted, are made out of each sheet of flat stock B.

FIG. 1 shows an inclined shingle conveyor belt 14, continuously running from right to left, in a well-known shingle flow system and also not further depicted. On the shingle-flow conveyor belt 14 a shingled stream of flat-stock sheets B is made available. A gripper apparatus 2 constructed here as a pivoting gripper is mounted, movable back and forth according to the double-ended arrows, in a certain pivot area. The gripper apparatus 2 can pivot out in a known manner at the left end of the shingle-flow conveyor belt in FIG. 1 and, at the associated dead center of its pivot motion, can grab the forward edge of the lowermost sheet of flat stock B at the shingle conveyor belt. Then the gripper apparatus 2 swings counterclockwise and at the same time accelerates the sheet of flat stock B to the cycling speed of the rotary die cutter. The sheet of flat stock B accelerated to cycling speed is shown in FIG. 1 in the pivot position of the gripper apparatus 2 to transfer to a sheet pick-up roller 3, which rotates at the cycling speed in the rotation direction R, here, clockwise, and is constructed, in particular, as a fixed-cycle roller.

The sheet pick-up roller 3 exhibits at its circumference two roller grippers 4 lying one behind the other in FIG. 1, which can be opened and closed. In their closed position, they hold the forward edge of the flat-stock sheet B fast and in their open position, they release it again. In the rotation direction R, suction holes 5 are disposed behind the roller gripper 4, equally spaced, which extend over a sector of about 80° of the circumference of the sheet pick-up roller 3. They are disposed in rows of suctions holes running parallel to the axis 11 of the sheet pick-up roller 3.

With the aid of the roller gripper 4 as well as of the suction holes 5, the sheet pick-up roller 3 transfers the flat-stock sheets B to the suction conveyor-belt apparatus 6 shown in FIG. 1. This includes a suction belt 7 driven at the cycling speed of the rotary die cutter, running continuously in the direction of the arrow, of the type, for example, shown in FIG. 5. As is shown in FIG. 5, the suction belt 7 exhibits perforation holes, through which ambient air can be sucked using the intake box 16 recognized in FIG. 1. Guidance of the suction belt 7 occurs with the aid of guide pulleys 9, 17, and 18, whereby the guide pulley 18 functions as drive pulley. After transferring the flat-stock sheet B from the sheet pick-up roller 3 to the suction belt 7, the rotary die cutter lastly transports it at cycling speed to the left in FIG. 1 and delivers it to a work station not depicted here and of no more interest.

In FIGS. 2, 3, and 4, it is easily recognized that the sheet pick-up roller 3 is constructed in a well-known manner, not circular but elliptical-like in shape, in order to make it possible for the gripper apparatus 2 to pivot past, back to top dead center to pick up the next sheet of flat stock B.

As is particularly shown in FIGS. 2-4, with the embodiment shown, the axis 11 of the sheet pick-up roller 3 is essentially vertically above the axis 10 of the guide pulley 9. The resultant course of the transfer of the flat-stock sheet B from the sheet pick-up roller 3 to the suction belt 7 is explained in more detail below.

In FIG. 2, the sheet pick-up roller 3 with its roller grippers 4 are in the 6-o'clock position. The roller grippers 4 are in their closed position and hold the forward edge of the flat-stock sheet B positively secure. At least the suction holes 5 covered by the sheet of flat stock in FIG. 2 are already being gradually charged with intake air within the framework of the preceding pick-up of the flat-stock sheet B from the gripper apparatus 2 against the rotation direction R of the sheet pick-up roller 3, and at least a considerable portion of the suction holes 5 is in contact with the flat-stock sheet B. As depicted in FIG. 2, the bend strength of flat-stock sheets B made of pulp sheet can lead here to the rear area (on the right in FIG. 2) of the flat-stock sheets B not fitting tightly on the sheet pick-up roller 3.

In FIG. 2, it may likewise be seen that the intake box 16 comes as close as possible to the right on the guide pulley 9. Nevertheless, a zone SZ with no suction effect results at the surface of the suction belt 7 forming the transport plane TE.

The transfer, without slipping and thus precisely aligned, of the flat-stock sheet B to the suction belt 7 can occur in different ways with regard to the zone SZ with no suction effect.

Within the scope of a first method for transferring the sheet of flat stock B to the suction belt 7, the roller grippers 4 of the sheet pick-up roller 3, shown at 6 o'clock in FIG. 2, are not yet open, and at least the suction holes 5 covered by the sheet of flat stock B are charged as always with intake air until the rotation position of the sheet pick-up roller 3 shown in FIG. 3 is reached.

In the rotation position of the sheet pick-up roller 3 in FIG. 3, the roller grippers 4 are right at the beginning of the intake zone of the suction belt 7, which is defined by the extent of the intake box 16. At approximately this moment, the roller grippers 4 are opened, so that they release the forward edge of the flat-stock sheet B. In addition, the intake-air charging of the suction-hole rows created by the suction holes 5 is switched off using a known and suitable control valve, such that, to be precise, at uniform time lags, first the row of suction holes located all the way to the left in FIG. 3, immediately behind the roller grippers 4, has no suction effect, then the second row of suction holes from the left, and then the third, and so on gradually until all the rows of suction holes have no suction effect and as a result no more exert a cohesive force on the sheet of flat stock B. At the same time, the cut-off of intake-air charging occurs respectively for a row of suction holes whenever it is approximately at 6 o'clock.

A second method for transferring the sheet of flat stock B to the suction belt 7 differs from the first method in that the roller grippers 4 are already open when they are in the 6 o'clock position of FIG. 2. The roller grippers 4 are consequently then moved into their open positions if the direction of motion of the forward edge of the flat-stock sheet B lies on the transport plane TE. Accordingly, the forward edge of the sheet of flat stock B reaches the suction belt 7 without rising up over the transport plane TE at the suction belt 7 and is transported in the zone SZ that is without suction effect only by means of the suction holes 5 in the sheet pick-up roller 3. The gradual cut off of intake-air charging for each of the rows of suction holes also occurs at the 6 o'clock position.

Independent of the manner in which the transfer of the flat-stock sheet B to the suction belt 7 occurs, the area ZB shown in FIG. 4 for the flat-stock sheet B, increases little by little and in that area the flat-stock sheet B is held at the surface of the suction belt 7 by the intake air sucked in through the intake box 16. The increasing area ZB begins at the forward edge of the sheet of flat stock B and extends to the right end of the intake box 16 in FIG. 4. At such a rate, that the increasing area ZB increases in surface area, the area decreases where the sheet of flat stock B is still being held on the sheet pick-up roller 3. It may be seen in FIG. 4 that the sheet of flat stock B is held exclusively by intake air during the phase of transfer between the sheet pick-up roller 3 and the suction belt 7, in which the suction belt 7 conveys with cycling speed and the sheet pick-up roller 3 tracks with cycling speed in the same way. As long as the increasing area ZB is relatively small and the suction belt 7 for that reason exerts only a slight cohesive force on the sheet of flat stock, in this way it is ensured according to the invention that no slippage occurs between the suction belt 7 and the sheet of flat stock B, and the flat-stock sheet B can be supplied precisely aligned to the work station of the rotary die cutter.

Provided that the spatial relationships with respect to the movement path of the gripper apparatus 2 permit it, the possibility alternatively exists of setting the sheet pick-up roller 3 in FIGS. 2-4 as far to the left of the axis 10 of the guide pulley 9 as necessary, so that the zone SZ without suction effect, which is shown in FIG. 2, lies, for the roller grippers 4 already at 6 o'clock, in the direction of rotation R behind the roller grippers 4 or the forward edge of the sheet of flat stock B. Accordingly, the roller grippers 4 in this case, as in the second method described previously, may be opened at the 6 o'clock position.

As may be seen in FIGS. 2-4, the roller grippers 4 project radially above the surface of the sheet pick-up roller 3. Based on this, the suction belt 7 corresponding to FIG. 5 exhibits two drop spaces 8 in the form of throughholes, whose distance apart corresponds to the axial separation of the roller grippers 4 of the sheet pick-up roller 3. At the beginning of the transfer process (see in particular the 6 o'clock position according to FIG. 2), the roller grippers 4 drop into the drop spaces 8 so that in a advantageous manner the transport plane TE of the suction belt 7 lies tangent to the orbit passed through by the suction holes 5.

Alternatively, the perforated suction belt 7 shown in FIG. 5 can be divided lengthwise so that two perforated suction belts are created running parallel to one another, in which each suction belt has one of the drop spaces 8.

A further alternative exists in which the suction conveyor-belt apparatus 6 instead of the suction belt 7 is fitted with four relatively narrow suction belts 12 according to FIG. 6, for example. At the same time, the suction belts 12 can be arranged separated by spaces 13, so that suction air can be sucked through the spaces 13 to hold the flat-stock sheet B tightly. In the embodiment shown in FIG. 6, the suction of the intake air occurs through intake openings 19 which are disposed in an intake box located underneath the suction belts 12 visible in FIG. 6. The roller grippers 4, can at the beginning of the transfer of the flat-stock sheet B to the suction belts 12, drop into the current outside space 13, whose separation corresponds to the distance between the two roller grippers 4. This has the advantage over the suction belt 7 that the suction belts 12 do also have to be driven at cycling speed but do not need to maintain a precisely timed specific rotation position relative to the sheet pick-up roller 3.

REFERENCE LIST

1 Device
2 Gripper apparatus
3 Sheet pick-up roller
4 Roller gripper
5 Suction holes

6 Suction feed apparatus
7 Suction belt
8 Drop space
9 Guide pulley
10 Axis of guide pulley
11 Axis of sheet pick-up roller
12 Suction holes
13 Space
14 Shingle flow conveyor belt
15 Perforation holes
16 Intake box
17,18 Guide pulleys
19 Suction openings
B Flat-stock piece
R Rotation direction
SZ Zone without suction effect
TE Transport plane
ZB Increasing area

The invention claimed is:

1. A device for pulling in flat-stock pieces and precisely-aligned transporting of the flat-stock pieces at a work station of a machine for processing the flat-stock pieces, comprising:

a gripper apparatus that grabs a forward edge of a piece of flat stock and accelerates the flat-stock piece, and at least one sheet pick-up roller that picks up the accelerated piece of flat stock from the gripper apparatus, whereby the sheet pick-up roller comprises at least one roller gripper effective at a circumference thereof for grabbing the accelerated piece of flat stock, wherein the roller gripper can move between a closed position in which the piece of flat stock is held fast and an open position in which the piece of flat stock is released, a plurality of suction holes operable to be charged with intake air are disposed in a part of a circumference of the sheet pick-up roller following in a direction of rotation behind the roller gripper, a suction conveyor-belt apparatus is provided with at least one suction belt operable to be charged with intake air, and a movement of the roller gripper from the closed position to the open position and the intake-air charging of the suction holes can be controlled so that the piece of flat stock can be transferred, without substantial slipping, from the sheet pick-up roller to the suction belt.

2. A device according to claim 1, wherein the suction belt comprises a number of drop spaces corresponding to a number of roller grippers, wherein the respective roller gripper drops into the drop space when transferring the piece of flat stock to the suction belt.

3. A device according to claim 2, wherein the suction conveyor-belt apparatus comprises a guide pulley to guide the suction belt, whose axis is disposed substantially vertically beneath an axis of the sheet pick-up roller.

4. A device according to claim 3, wherein the suction holes at the circumference of the sheet pick-up roller extend over an angular sector of less than 90°.

5. A device according to claim 2, wherein the suction holes at the circumference of the sheet pick-up roller extend over an angular sector of less than 90°.

6. A device according to claim 1, wherein the suction conveyor-belt apparatus comprises a plurality of suction belts disposed running parallel to one another and with spaces therebetween, whereby the roller gripper drops into one of the spaces when transferring the piece of flat stock to the suction belts.

7. A device according to claim 6, wherein the suction conveyor-belt apparatus comprises a guide pulley to guide the suction belt, whose axis is disposed substantially vertically beneath an axis of the sheet pick-up roller.

8. A device according to claim 7, wherein the suction holes at the circumference of the sheet pick-up roller extend over an angular sector of less than 90°.

9. A device according to claim 6, wherein the suction holes at the circumference of the sheet pick-up roller extend over an angular sector of less than 90°.

10. A device according to claim 1, wherein the suction conveyor-belt apparatus comprises a guide pulley to guide the suction belt, whose axis is disposed substantially vertically beneath an axis of the sheet pick-up roller.

11. A device according to claim 10, wherein the suction holes at the circumference of the sheet pick-up roller extend over an angular sector of less than 90°.

12. A device according to claim 1, wherein the suction holes at the circumference of the sheet pick-up roller extend over an angular sector of less than 90°.

13. A method for pulling in pieces of flat stock and transporting the pieces of flat stock, precisely aligned, into a work station of a machine for processing the pieces of flat stock comprising:

grabbing a forward edge of a piece of flat stock and accelerating the piece of flat stock with a gripper apparatus, and picking up the accelerated piece of flat stock with at least one rotating sheet pick-up roller from the gripper apparatus, whereby the accelerated piece of flat stock is grabbed by at least one roller gripper at a circumference of the sheet pick-up roller, which can move between a closed position, in which the piece of flat stock is held fast, and a open position in which the piece of flat stock is released, wherein the piece of flat stock is held, in addition to being held by the roller gripper, by intake air sucked through suction holes at the circumference of the sheet pick-up roller, in which the suction holes are located in a part of the circumference of the sheet pick-up roller which is following behind the roller gripper in a direction of rotation, and the piece of flat stock is transferred by the sheet pick-up roller to at least one suction belt charged with intake air of a suction conveyor-belt apparatus, by moving the roller gripper from the closed position into the open position and operating the suction holes beginning with the suction holes lying next to the roller gripper against the direction of rotation of the sheet pick-up roller are operated one after the other at the least without intake air, so that the piece of flat stock is held fast during transfer between the sheet pick-up roller and the suction belt in a dimensionally increasing area without substantial slipping on the suction belt and is transported in a dimensionally decreasing area, still being held on the sheet pick-up roller, in a guiding member.

14. A method according to claim 13, wherein the roller gripper is moved into the open position if a direction of motion of the forward edge of the flat-stock piece lies in a transport plane formed by the suction belt.

15. A method according to claim 13, wherein the roller gripper is first moved into the open position if the forward edge of the flat-stock piece held thereby has been transported through a zone of the suction belt without a suction effect.

16. A method according to claim 15, wherein the forward edge of the piece of flat stock is moved out of the transport plane of the suction belt during transportation through the zone of the suction belt without a suction effect.

17. A method according to one of claim 13, wherein the suction holes are disposed in the form of rows of suction holes parallel to an axis of the sheet pick-up roller, which are charged to pick up the sheets of flat stock from the gripper apparatus individually one after the other with intake air or are operated at the least without intake air to transfer the sheets of flat stock to the suction belt individually one after the other.

18. A method according to one of claim 13, wherein the suction holes are disposed in the form of rows of suction holes parallel to an axis of the sheet pick-up roller, of which two or more adjacent rows of suction holes each form a suction-hole group, in which the groups of suction holes are charged with intake air to pick up the sheets of flat stock from the gripper apparatus individually one after the other and/or are operated at the least without intake air to transfer the sheets of flat stock to the suction belt individually one after the other.

19. A method according to claim 13, wherein the roller gripper, when transferring the sheet of flat stock to the suction belt, drops into a drop space which is provided in the suction belt.

20. A method according to claim 13, wherein the suction conveyor-belt apparatus comprises several suction belts disposed running parallel to one another and with spaces and the roller gripper, when transferring the piece of flat stock to the suction belts, drops into one of the spaces.

* * * * *